United States Patent [19]

Mori

[11] Patent Number: 4,827,641

[45] Date of Patent: May 9, 1989

[54] INDEX DEVICE

[75] Inventor: Chuzo Mori, Funabashi, Japan

[73] Assignee: Carl Manufacturing Co., Ltd., Tokyo, Japan

[21] Appl. No.: 49,964

[22] Filed: May 15, 1987

[30] Foreign Application Priority Data

Jun. 10, 1986 [JP] Japan ..... 61-88233[U]

[51] Int. Cl.[4] ..... B42F 17/20

[52] U.S. Cl. ..... 40/376; 188/130; 188/268

[58] Field of Search ..... 40/377, 376; 188/268, 188/130

[56] References Cited

U.S. PATENT DOCUMENTS 2,000,086 5/1935 Mallory ..... 188/130

4,098,375 7/1978 Kornylak ..... 188/268

FOREIGN PATENT DOCUMENTS 171377 11/1985 Japan .

*Primary Examiner*—Ira S. Lazarus

*Assistant Examiner*—Sue Hagarman

*Attorney, Agent, or Firm*—Oliff & Berridge

[57] ABSTRACT

There is disclosed an index device in which a cover member is axially attached to a receptacle so as to be openable and closable, and a multiplicity of cards are accommodated therebetween so as to be superposed on each other. This indexing device is arranged such that: a rotation resisting member including viscous substance for moderating the resilient repulsion forces when the cover member is unfolded from the receptacle is provided between the receptacle and the cover member; the rotation resisting member has a rotor which rotates within hermetically sealed casings attached to the receptacle and filled with the viscous substance; and notches are formed in a peripheral portion of the rotor.

5 Claims, 2 Drawing Sheets

INDEX DEVICE

BACKGROUND OF THE INVENTION

1. Field of the Invention

The present invention is directed to an improvement of an index device wherein a multiplicity of cards having telephone numbers and other index items recorded are accomodated in between a receptacle and a cover member, and a sheet of the card on a desired page appears when opening the cover member.

2. Description of the Prior Art

The index device is provided with a good number of cards for keeping records of telephone numbers and other indexing items, these cards being accomodated in between the receptacle and the cover member. This kind of index device is arranged in such a way that the card on the desired page is retrieved by means of a slider, the cover member is unlocked from the receptacle by pushing a knob with a finger and is soon opened by dint of spring forces, and the card (upper portion) just before the one on the desired page is raised up together with the cover member. Therefore, if the desired page is positioned beneath a multiplicity of cards, the cover member is situated so as to be integral with a great majority of such cards.

In order to open the card just before the desired page together with the cover member even if the desired page among a good number of cards is in any position, it is required to invest a spring with large resilient repulsion forces sufficient to open the cover member from the receptacle. Videlicet, if the spring lacks resilient repulsion forces, the card on the desired page is by no means opened because of a lack of the forces when the desired page is situated under a good number of the cards. While on the other hand, if the spring is strengthend very much, the spring is so intensive that the cover member is instantaneously opened at a high velocity when the desired page is positioned on a multiplicity of the cards. As a result, the indexing device as a whole vibrates on the desk, which is conclucive to a problem of making a noisy sound.

To cope with this problem, the receptacle of the indexing device is composed of a thick iron plate or is provided with a suitable heavy weight to offset the reaction when the cover member is quickly opened. This arrangement, however, brings about disadvantages of being costly both in material and in transport. Besides, it makes no contribution to the fundamental solution of restraining the cover member from being quickly opened. This quick opening action of the cover member unfavourably induces not only the vibration but also adsorption of the card on the opening page to the next card. These problems are not obviated by the aforementioned arrangement. The present applicant who had been inspired by the above-described circumstances developed an indexing device which makes the most of viscosity intended to resist the opening forces of the cover member. This proposal is disclosed in the specification of Japanese Patent Utility Model Laid-Open No. 171377/1985.

The already disclosed indexing device is, as illustrated in FIG. 5, arranged as follows. A bearing member consisting of annular grooves 42 formed in the a cover member 41 and protrusions 43 which are formed on a receptacle 40 and are rotatably fitted in the annular grooves 42 is provided at a portion where the receptacle 40 and the cover member 41 are axially attached.

The annular grooves are filled with a viscous substance made of resin or the like which serves to yield stopping forces against the opening motion of the cover member in order to moderate the intensive repulsion when the cover member is unfolded in a gradually accelerated manner by dint of a given reverse spring immediately after releasing the hook thereof, whereby the cover member is opened at a substantially equalised velocity.

All the above-mentioned problems could be solved by the thus constructed indexing device which is advantageous in terms of function and production costs as well. The annular protrusions are fitted in the annular grooves, and gaps formed therebetween are charged with the viscous substance like silicon grease. Such a constitution, however, causes a problem in which the viscous substance leaks out little by little during a long period of use and the leakage spoils the function thereof.

The viscous substance supplied to the bearing member is intruded in the narrow gaps formed between the inner walls of the annular grooves and the protrusions, its quantity therefore becomes extremely small. In proportion as the amount of the viscous substance increases, the capability to correct the unevenness in velocity of inversion of the spring which is generated with the passage of time is enhanced. Hence, it is highly desirable that the limited space be filled with the greatest amount of viscous substance.

SUMMARY OF THE INVENTTON

It is a primary object of the present invention to maintain the capability to equalise the velocity of inversion of a spring for a long period of time by changing a structure of a bearing member and further to improve this capability.

To this end, according to one aspect of the invention, there is provided a structure intended to prevent the leakage of the viscous substance in a rotary member which imparts resistance to the rotary member during a long strech of use.

To accomplish the above-described objects, in an indexing device wherein: a cover member whose opening is formed downwards and a receptacle whose opening is formed upwards are axially so attached to each other at their proximal portions as to be freely openable and closable; the cover member biased by a spring in the opening direction; a multiplicity of cards are so accomodated in between the receptacle and the cover member as to be superposed on each other; and a sheet of the card is open just when unfolding the cover member secured to the receptacle, the improvement characterised in that a rotation resisting member provided at a portion where the cover member and the receptacle axially are attached comprises: a rotor having a flange partially formed with notches and a shaft member protruding from the center of the flange; casings for covering the entire rotor in such a way that the shaft member alone is protruded from one surface; and a viscous susbstance filling the casings.

In such a construction, when the cover member secured to the receptacle is unfolded, the rotation resisting member serves to resist the rotational motion, whereby the cover member is, as in the case of the device of the aforementioned application, opened at a proper velocity. Then the viscous substance is reserved in the notches formed in the flange of the rotor, and the casings are tightly bonded so that the viscous substances never leaks out.

DETAILED DESCRIPTION OF THE PREFERRED EMBODIMENT

Figure 1:
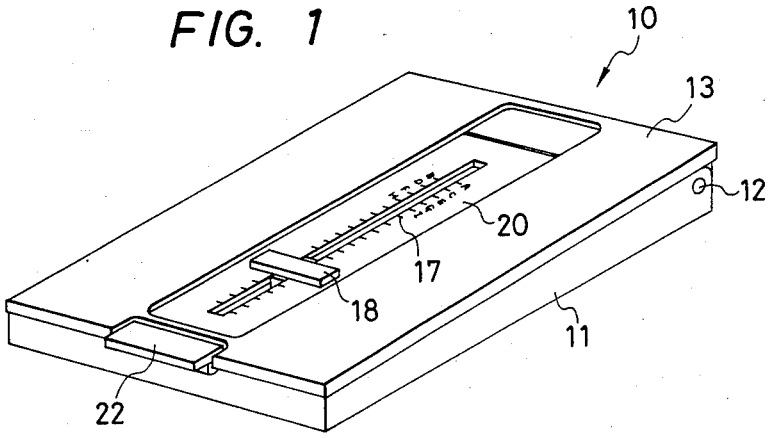
FIG. 1 is a perspective view of an indexing device which incorporates a rotation resisting member of the present invention.
Figure 2:
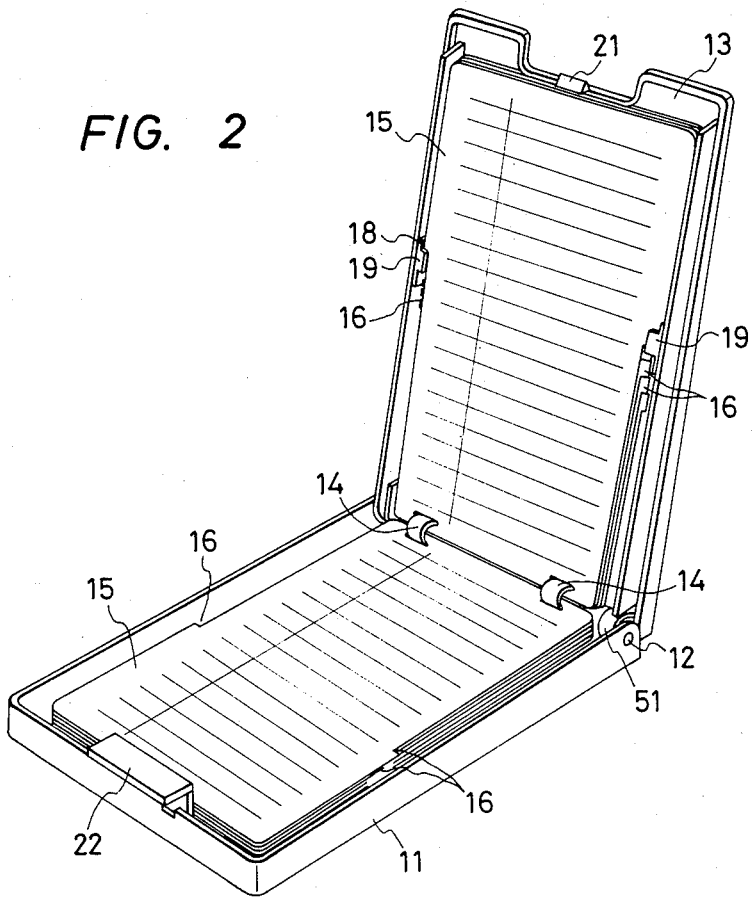
FIG. 2 is a perspective view showing a state where a cover member of the indexing device of FIG. 1 is open.
Figure 3A:
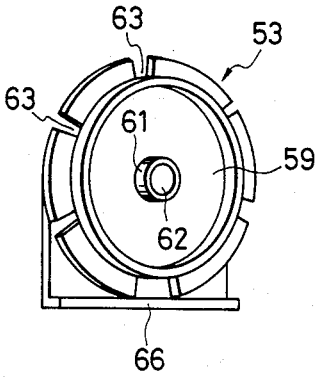
FIG. 3*a* is a side view of casings viewed from the inside thereof.
Figure 3B:
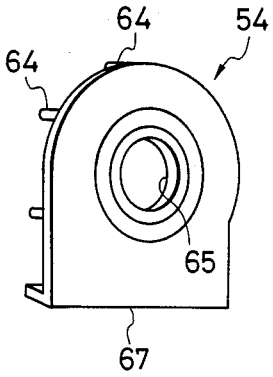
FIG. 3*b* is a perspective view of the casings viewed from the other side.
Figure 3C:
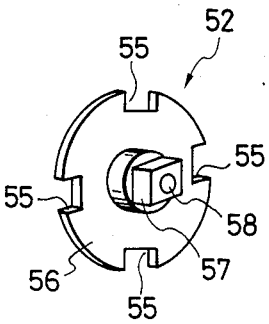
FIG. 3*c* is a perspective view of a rotor accomodated in a space formed by installing the casings illustrated in FIGS. 3*a* and 3*b;*

One example of an indexing device 10 will be described with reference to FIGS. 1 and 2. A receptacle 11, as illustrated in the Figures, assumes a dish-like configuration, the opening of which is formed upwards, whereas the opening of a cover member 13 is formed downwards. The proximal portion of the cover member 13 is axially attached through a spindle 12 to that of the receptacle 11. The rotation is made about this spindle to open and close the cover member. The spindle 12 is wound with an unillustrated linear spring. One end of the spring is in press-contact with the inner surface of the receptacle 11, and the other end thereof is likewise in press-contact with the inner surface of the cover member 13 (both ends are hidden behind cards 15). The spring serves to thrust the cover member 13 in the opening direction with respect to the receptacle 11.

A pair of rings 14 fitted to the outer periphery of the spindle 12; and the proximal portions of a multiplicity of the cards 15 are bound by these rings 14. The bilateral portions of these cards 15 are formed with notches 16 which deviate in position for every card. A shape of the notch 16 corresponds to a protrudent piece (a card opener) 19 provided on the inside portion of a slider 18 of the cover member 13 which moves along a slot illustrated in FIG. 1. The slider 18 moves according to index alphabetic letters 20. The cover member 13 is formed with a protrusion 21, and the receptacle is provided with a knob 22 which engages with the protrusion 21. When the cover member 13 is, as shown in FIG. 1, closed, the protrusion 21 engages with the knob 22. Upon release of the engagement by pushing the knob 22, the cover member 13 is opened by forces of an unillustrated spring.

When pushing the knob, the cover member 13 is thus opened by dint of the spring. In the indexing device according to the present invention, rotation resisting member functions.

Figure 4:
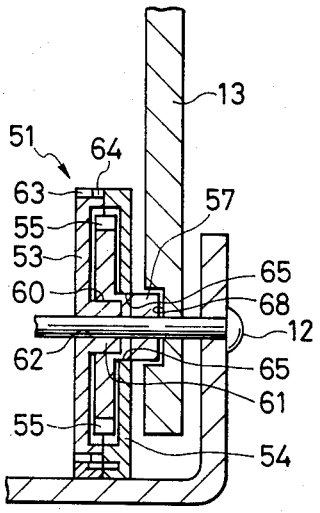
FIG. 4 is a sectional view showing a state where the rotation resisting member of the present invention is incorporated in between the receptacle and the cover member of the indexing device.
Figure 5:
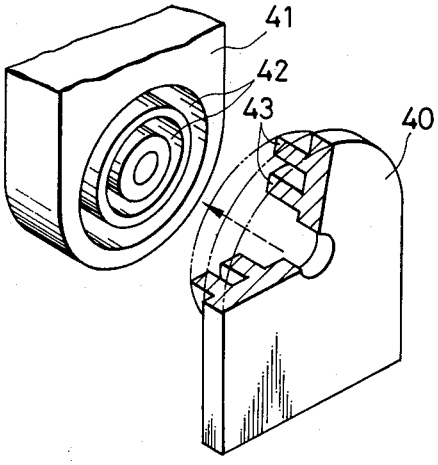
FIG. 5 PRIOR ART
FIG. 5 is a perspective view showing one example of a conventional rotation resisting member.

In the second place, one embodiment of the present invention will be explained with reference to the accompanying drawings. A numeral 51 is shown in FIG. 4 represents the rotation resisting member according to the present invention which essentially consists of a resinous rotor 52 and casings 53, 54 (these casings are composed of the same material as that of the rotor 52) for covering the rotor 52 in such a way that it is sandwiched in between these casings. The rotor 52 comprises a flange 56 partially formed with notches 55 and an angular shaft member 57 which juts out from the central portion of the flange 56. The angular shaft member 57 assumes rectangularity in outline, and its central portion is formed with a hole through which a spindle (this spindle, which will be mentioned later, axially connects the cover member to the receptacle) is inserted.

A recessed portion 59 which accommodates the rotor 52 is formed in a part of the casing 53. A protrusion 61 which is fitted in a recessed portion 60 (see FIG. 2) formed in the central portion of the rotor 52 is provided at the center of the recessed portion 59. The central portion of this protrusion 61 is also formed with a hole 62 corresponding to the hole of the rotor 52. A plurality of recessed portions 63 are formed at adequate spacings in the outer peripheral portion of the casing 53, these recessed portions 63 receiving protrudent pins 64 of the casing 54 which will next be explained. The casing 54 includes a hole 65 which undergoes insertion of the angular shaft member 57.

The thus constituted rotation resisting member 51 is arranged such that: the viscous substance is sufficiently adhered to the rotor 52; the rotor 52 is then interposed in between the casings 53, 54; the protrudent pins 64 are fixedly fitted in the recessed portions 63; alignment surfaces of the casings 53, 54 are so bonded as to be integral with each other; and the angular shaft member 57 of the rotor 52 is made to project from the hole 65 of the casing 54. As the viscous substance, high polymeric materials having viscosity or rubber can directly be employed or may be mixed with other additional matters. It is favorable to use the materials which are at least of a non-volatile type and undergo no considerable change in quality when the temperature varies. The material may involve the one having high viscosity which is selected among, for instance, viscous silicon grease like G330, G331, etc. (trade name) made by Shinetsu Chemical Industry Co., Ltd.(Japan)

The thus constructed rotation resisting member 51 is installed in such a manner that rectilinear portions 66, 67 provided at the lower parts of the casings 53, 54 impinge upon the bottom of the receptacle 11 of the indexing device 10, and the spindle 12 is inserted into the holes 58, 62 when the cover member 13 is axially attached through the spindle 12 to the receptacle 11. In this case, if the position of the spindle 12 is properly determined with respect to the bottom of the receptacle 11, it is unnecessary to make the rotation resisting member fix to the receptacle 11. In the case of installing the rotation resisting member 51 in that position, the angular shaft member 57, protruded from the hole of the casing 54, of the rotor 52 is made to engage with the cover member 13. In connection with the structure, a recessed portion 68 (in this case, the recessed portion assumes rectangularity, but the configuration may include any shapes except circularity), and the angular shaft member is fitted therein. The casings 53, 54 of the rotation resisting member 51 are incorporated with each other on the side of the receptacle 11, and the rotor 52 which is subjected to the resistance of the viscous substance with respect to the receptacle 11 is rendered integral on the side of the cover member 13. Consequently, when the cover member is opened, the rotor 52 rotates within the casings 53, 54. Inasmuch as the casings 53, 54 are filled with the viscous substance, the force of the spring acts such as to open the cover member 13, resisting the viscous substance. As a result, the cover member is opened at an adequate velocity. The viscous substance moves while turning in the notches 55 formed in the flange 56 of the rotor 52 and hence it undergoes no influence even if there is some air content. The viscous substance invariably exhibits uniform resistivity.

Since the present invention is constituted in the above-described manner, the cover member is always opened at the proper velocity. The cover member is never opened quickly, so that no vibration is created on the desk and at the same time no loud sound is given forth. It is therefore feasible to adopt light materials like resin of which the receptacle is composed, this leading to a decrease in cost. Since the quick opening action is not effected, the card next to the desired page is by no means drawn up by adsorption. The viscous substance does not leak out from the rotation resisting member and the stable function can therefore be held for a long period of time.

What is claimed is:

1. In an index device wherein proximal portions of a receptacle, whose opening is formed upwards and of a cover member whose opening is formed downwards, undergo insertion of a spindle so that said cover member is openable and closable, said cover member is biased by a spring in its opening direction, a multiplicity of cards are so accommodated in between said receptacle and said cover member as to be superposed on each other, a sheet of the card is open just when unfolding said cover member secured to said receptacle, and there is provided a rotation resisting member for moderating repulsion forces of said spring, said rotation resisting member being so arranged as to interpose a viscous substance in between said receptacle and said cover member, wherein the improvement comprises:

one casing formed with a hole through which said spindle passes;

the other casing coaxially fitted in said one casing, said two casings including a space formed therebetween;

a rotor having notches formed in a flange thereof, said rotor turning about said spindle within the space;

viscous substance charged in between an inner wall of said casing and said flange within the space; and a non-circular member having continuity with a cylindrical member provided a central portion of said rotor, said cylindrical member being rotatable with respect to a central hole formed in said the other casing, said non-circular member protruding from said casing and unrotatably engaging with said cover member rotatable about said spindle.

2. An index device as set forth in claim 1, wherein an axial hole of said other casing is formed in said cylindrical member fitted in a recessed portion at the center of said rotor.

3. An index device as set forth in claim 1, wherein attachment portions of said two casings are bonded to each other by a bonding agent.

4. An index device as set forth in claim 1, wherein said notches are formed in a plurality of positions.

5. In an index device wherein proximal portions of a receptacle, having an opening formed upwards and of a cover member having an opening formed downwards, undergo insertion of a spindle so that said cover member is openable and closable, said cover member is biased by a spring in its opening direction, a multiplicity of cards are so accommodated in between said receptacle and said cover member so as to be superposed on each other, a sheet of card is opened when unfolding said cover member secured to said receptacle, and there is provided a rotation resisting member for moderating repulsion forces of said spring, said rotation resisting member being arranged so as to interpose a viscous substance in between said receptacle and said cover member, wherein the improvement comprises:

one casing formed with a hole through which said spindle passes, said casing comprising protrudent pins;

the other casing having recessed portions for receiving said protrudent pins, said other casing coaxially fitted in said one casing, said two casings including a space formed therebetween;

a rotor having notches formed in a flange thereof, said rotor turning about said spindle within the space formed between said two casings;

viscous substance charged in between an inner wall of said casing and said flange within the space; and a non-circular member having continuity with a cylindrical member provided at a central portion of said rotor, said cylindrical member being rotatable with respect to a central hole formed in said other casing, said non-circular member protruding from said casing unrotatably engaging with said cover member rotatable about said spindle.

* * * * *